US005117533A

United States Patent [19]

Stuller

[11] Patent Number: 5,117,533

[45] Date of Patent: Jun. 2, 1992

[54] BELLED SUCTION PIPE FOR COTTON GIN

[75] Inventor: Howard E. Stuller, Lubbock, Tex.

[73] Assignee: Industrial Business Consultants, Inc., Lubbock, Tex.

[21] Appl. No.: 657,533

[22] Filed: Feb. 19, 1991

[51] Int. Cl.[5] ..... D01B 1/04

[52] U.S. Cl. ..... 19/64.5; 19/39; 15/414; 15/415.1; 406/116

[58] Field of Search ..... 19/64.5, 39, 48 R; 138/96 R, 109, 110, 113, 114, 155; 406/116, 193; 285/31; 15/414, 415.1

[56] References Cited

U.S. PATENT DOCUMENTS

| | | | |
|---|---|---|---|
| 859,204 | 7/1907 | Dana | 15/415.1 |
| 1,067,802 | 7/1913 | Dana | 15/415.1 |
| 1,140,992 | 5/1915 | Martin | 15/414 |
| 1,398,930 | 11/1921 | Bennett | 19/39 |
| 1,560,612 | 11/1925 | Sims | 15/415.1 |
| 2,178,934 | 11/1939 | Hamilton | 406/116 |
| 2,803,847 | 8/1957 | Hobbs | 15/414 |
| 3,018,135 | 1/1962 | Reib | 406/116 |
| 3,114,938 | 12/1963 | Bryant | 19/39 |
| 3,228,728 | 1/1966 | Beckett et al. | 406/116 |
| 3,235,314 | 2/1966 | Schorer | 406/116 |
| 3,262,742 | 7/1966 | Sipe et al. | 406/116 |
| 4,436,457 | 3/1984 | Willingham | 406/116 |

OTHER PUBLICATIONS

Stuller "Suction Hand" brochure by Industrial Business Consultants, Inc., 1976.

Industrial Ventilation "A Manual of Recommended Practice" from Committee on Industrial Ventilation, 1978.

*Primary Examiner*—Werner H. Schroeder
*Assistant Examiner*—Michael A. Neas
*Attorney, Agent, or Firm*—Wendell Coffee

[57] ABSTRACT

An integral polyurethane bell is placed on the bottom of a suction pipe of a cotton gin. A hook is placed on the top of the outer barrel of the suction pipe and a chain swung from pivot mechanism of the suction pipe. When the suction pipe is not in operation the hook is engaged to the chain to hold the suction pipe in a non-obstructive position. Nylon bearing pads are placed between the inner and outer barrels of the suction pipe.

14 Claims, 2 Drawing Sheets

BELLED SUCTION PIPE FOR COTTON GIN

CROSS REFERENCE TO RELATED APPLICATION

None, however. Applicant filed Disclosure Document Number 246,797 on Mar. 7, 1990 which document concerns this application.

BACKGROUND OF THE INVENTION (1) Field of the Invention

This invention relates to cotton gins and more particularly to suction pipes for conveying seed cotton as harvested and as received by the gin pneumatically to the cotton gin for processing. Cotton gin operators have ordinary skill in the art.

(2) Description of the Related Art

Suction pipes for cotton gins are old. One is shown in U.S. Pat. No. 488,446 which issued in 1892.

Typically the suction pipe includes an inner barrel which is suspended from a pivot mechanism and has an outer barrel telescoped around the inner barrel. A suction fan is connected to the inner barrel for sucking cotton. Until about 1970, the cotton was conveyed to the gin suction in wagons or trailers and the cotton was sucked from the wagon or trailer into the cotton gin. At present much of the cotton is conveyed to the gin suctions as modules which are placed on the floor of the suction shed and are sucked from the module by the suction pipe.

Since about 1976 manipulation of many of the suction pipes has been remotely controlled. In a remote control system, the pivot mechanism is mounted on a carriage running on tracks lengthwise of the wagon, trailer, or module. The pivot mechanism would swing either lengthwise of the wagon, trailer, or module, or swing laterally of the lengthwise movement. In addition to this, the remote mechanism could control the telescoping of the outer barrel and the inner barrel.

Because of valve leakage of hydraulic systems used in the control system, the problem was experienced in the outer barrel drifting downward when not in use. To prevent this and also to move the suction pipe out of the way when wagons or trailers were brought under the suction pipe, it was customary to provide a hook on the frame work of the suction shed so that the suction pipe could be moved by the carriage carrying the pivot mechanism to the vicinity of the hook. Then, by the pivot mechanism, swing the suction pipe with the barrel fully retracted to the hook and then lowering the pipe onto the hook.

Also, by remote and mechanical manipulation of the suction pipe, sometimes the suction pipe was swung forcefully against the sides of the wagon or trailer resulting in damage to the sides of the wagon or trailer or deformation of the sheet metal of which the outer barrel was constructed.

To permit the longitudinal movement of the carriage carrying the pivot back and forth, it was necessary to have a horizontal run of telescope extension pipe. According to the prior art bearing pads were placed on the telescope pipe to prevent excessive wear. However, because the vertical section of the pipe was not subject to as much friction and wear, normally there were no pads used upon the vertical section of the suction pipe depending from the four-way pivot.

In modern day suction pipes, the remote control mechanism will often be 20 feet or more above the ground and each of the inner pipe and outer pipe, over 8 feet in length. The diameters of these pipes may range from 13 inches to 20 inches. However, most of them are between 15 and 18 inches in diameter.

SUMMARY OF THE INVENTION (1) Progressive Contribution to the Art

This application includes an improved method of hooking the outer barrel of the suction pipe to maintain it in the fully retracted or raised position, swung to one side. In this instance a chain is swung from the pivot frame and a hook is placed on the top end of the outer barrel. Then with a remote control mechanism the suction pipe may be fully raised or retracted and swung to the side where the chain is located. When the hook on the pipe is over the chain the pipe may be lowered to engage the chain.

A conical bell is placed at the bottom end of the outer barrel to serve two functions. First, it is made of yieldable, flexible polyurethane so that the bell, upon striking the sides of a wagon or trailer, does not damage the wagon or trailer, nor permit damage to the bottom of the suction pipe. In addition, better airflow is provided so that there is a greater efficiency in the flow of air and cotton into the suction pipe.

Bearing pads have been placed on the outside surface of the inner barrel and the inside surface of the outer barrel to reduce friction and wear.

(2) Objects of this Invention

An object of this invention is to convey seed cotton as it is received by the gin into the gin for processing.

Further objects are to achieve the above with devices that are sturdy, compact, durable, lightweight, simple, safe, efficient, versatile, ecologically compatible, energy conserving, and reliable, yet inexpensive and easy to manufacture, install, operate, and maintain.

Other objects are to achieve the above with a method that is rapid, versatile, ecologically compatible, energy conserving, efficient, and inexpensive, and does not require highly skilled people to install, operate, and maintain.

The specific nature of the invention, as well as other objects, uses, and advantages thereof, will clearly appear from the following description and from the accompanying drawings, the different views of which are not necessarily scale drawings.

Figure 1:
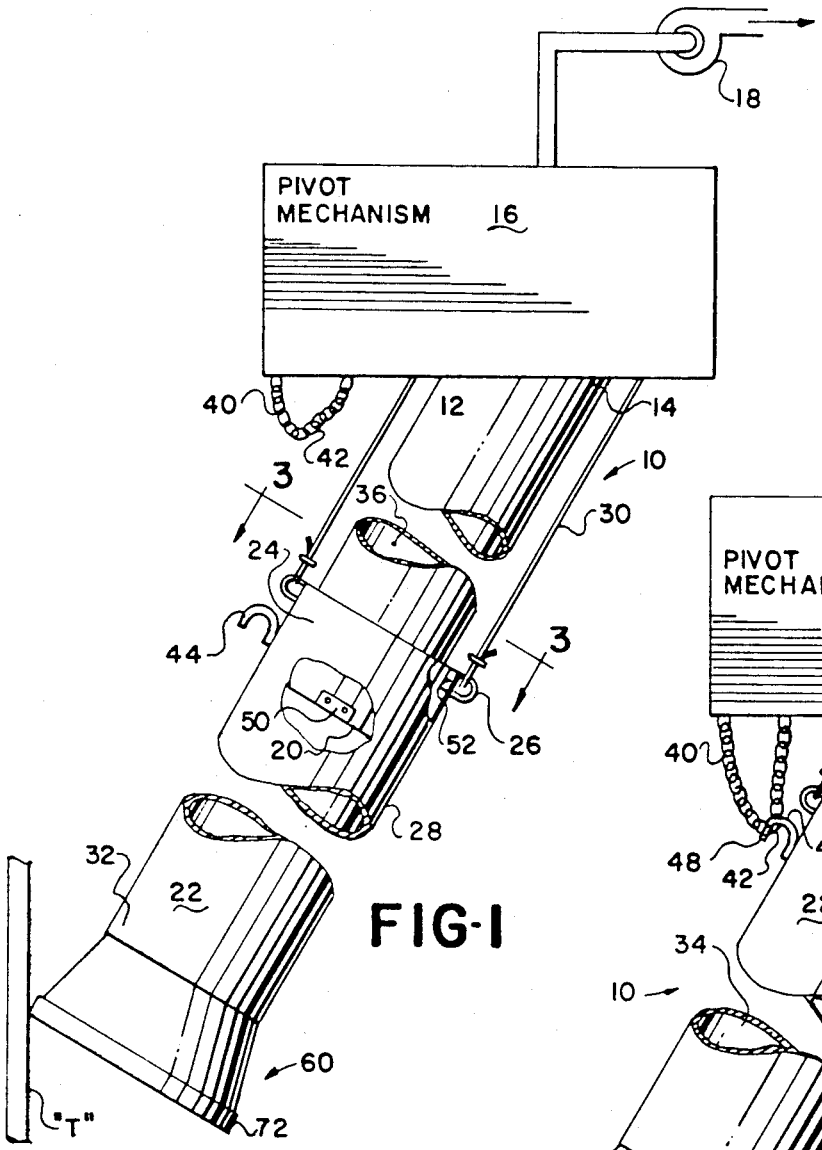
FIG. 1 is a schematic representation of a suction pipe according to this invention.
Figure 2:
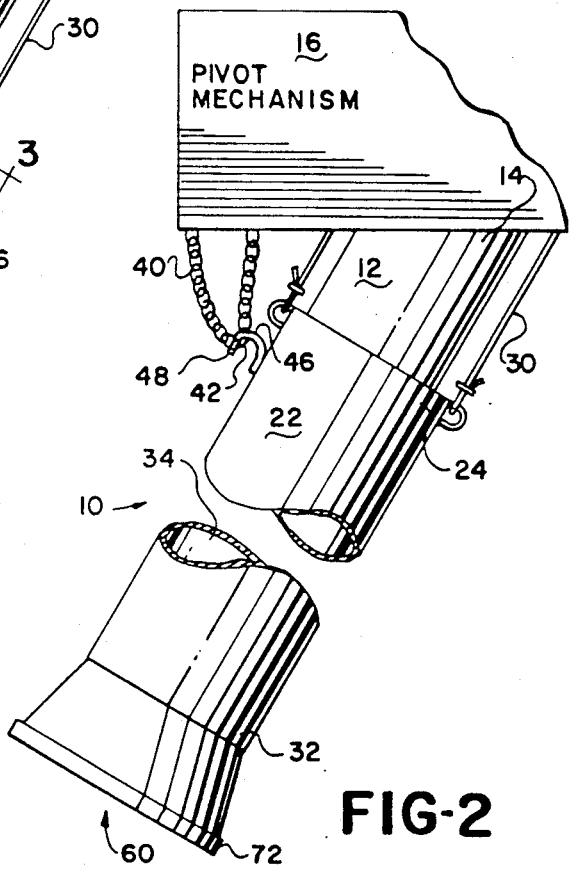
FIG. 2 is a detail of the upper portion of the suction pipe in the hung position.
Figure 3:
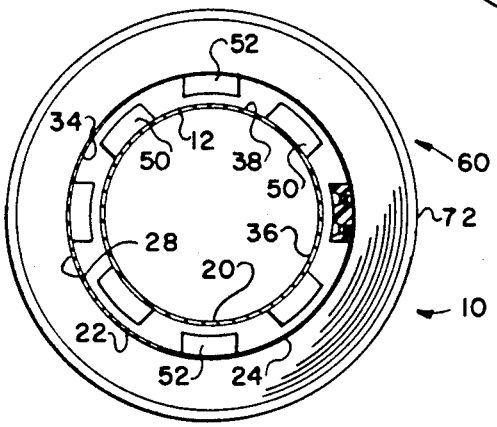
FIG. 3 is a cross-sectional view taken substantially on line 3—3 of FIG. 1.
Figure 4:
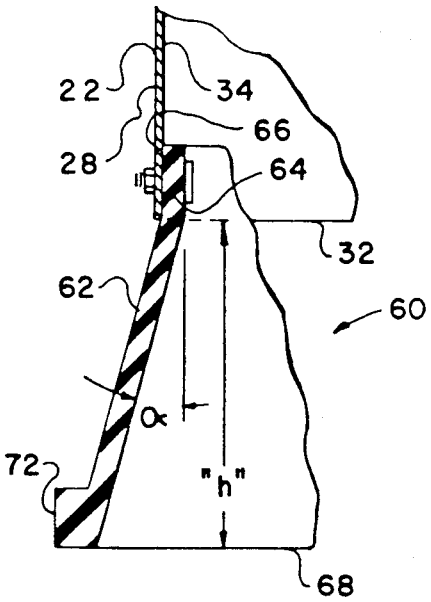
FIG. 4 is a partial diametrical view taken substantially on line 4—4 of FIG. 1.
Figure 5:
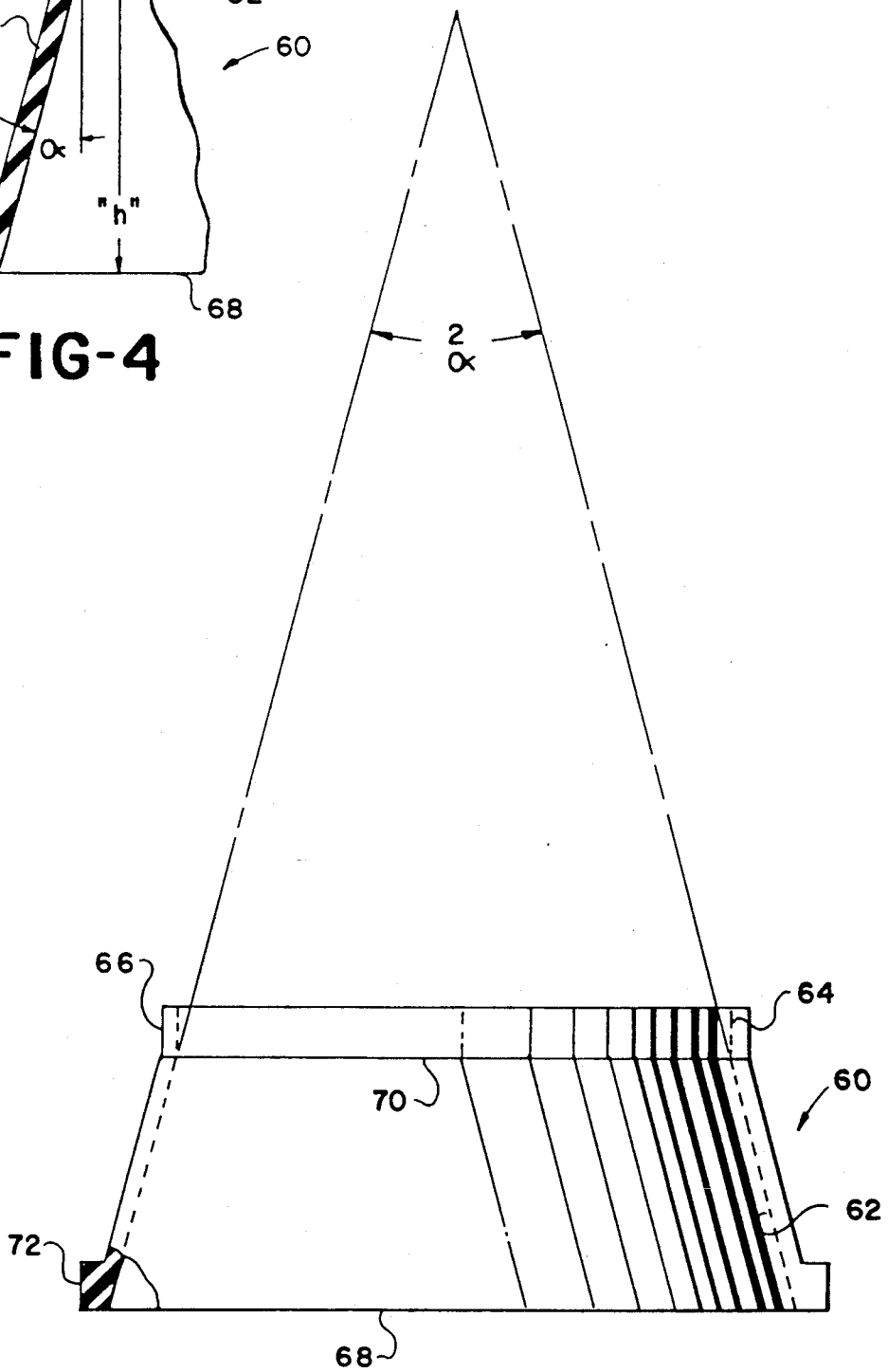
FIG. 5 is a detail of the bell according to this invention.

As an aid to correlating the terms of the claims to the exemplary drawings, the following catalog of elements and steps is provided:

| | |
|---|---|
| 10 | suction pipe |
| 12 | inner barrel |
| 14 | top end |
| 16 | 4 way pivot |
| 18 | fan |

-continued

| | |
|---|---|
| 20 | lower end |
| 22 | outer barrel |
| 24 | top end |
| 26 | lugs |
| 28 | outer surface |
| 30 | cable |
| 32 | bottom end of outer barrel |
| 34 | inner surface of outer barrel |
| 36 | inner surface of inner barrel |
| 38 | outer surface of inner barrel |
| 40 | chain |
| 42 | bight, chain |
| 44 | hook |
| 46 | bight, hook |
| 48 | hook point |
| 50 | bearing pads inner barrel |
| 52 | bearing pads outer barrel |
| 60 | bell |
| 62 | frustum |
| 64 | cylinder |
| 66 | outer surface |
| 68 | large end bell |
| 70 | small end |
| 72 | bumper |
| "α" | angles |
| "h" | height |
| "T" | trailer side |

DESCRIPTION OF THE PREFERRED EMBODIMENT

Referring to the drawings there may be seen a representation of suction pipe 10. The suction pipe will include an inner barrel 12 which is connected at its upper end 14 to a four-way pivot mechanism 16. Pneumatically the inner barrel 12 is connected through the four-way pivot mechanism to suction fan 18. The inner barrel includes a lower end 20.

Outer barrel 22 is telescoped around the inner barrel 12. At the upper or top end 24 of the outer barrel two loops or lugs 26 are attached to the outer surface 28 of the outer barrel. Flexible tension elements in the form of cables 30 are attached to the loops 26 and extend upward to up and down mechanism within the four-way pivot mechanism 16 whereby the outer barrel 22 may be raised and lowered. The loops 26 and cable 30 form a portion of a means for raising and lowering the outer barrel 22 on the inner barrel 12. The outer barrel 12 has a bottom end 32 and an inner surface 34. Likewise the inner barrel 12 has an inner surface 36 and an outer surface 38.

Those having ordinary skill in the cotton gin suction pipes recognize that the equipment described to this point is all old, well known, and commercially available.

A length of chain 40 is attached at each end to the pivot mechanism 16. The ends are spaced apart so that the chain loops down or forms a bight 42 between the two attachment points.

A hook 44 is attached to the outer surface 28 near the top end 24 of outer barrel 22. The hook 44 is turned downward so that it forms a bight 46 which is above the point 48. The bight 42 of the chain 40 extends downward low enough so that when the outer barrel 22 is fully raised by the means for raising, that the hook point 48 is above the bight 42. Then when the suction pipe 10 is swung to the side by the pivot mechanism 16 the hook 44 will be above the bight 42. Therefore with the suction pipe 10 maintained in a sideways position and then it lowered by the means for raising and lowering, the hook 44 with its bight 46 will engage the bight 42 of the chain 40. This will maintain the outer barrel 22 in a raised position very near its highest raised position and also, since it will be primarily suspended by the chain which is offset from the center line of the suction pipe 10 that it will be maintained to one side.

To disengage the hook 44 the outer barrel 22 is raised and the suction pipe 10 moved to a center position and then the outer barrel 22 lowered so that the hook is free of the chain 40.

Four inner barrel nylon bearing pads 50 are attached to the outer surface 38 of the inner barrel 12 near its lower end or bottom end 20. The pads are conveniently attached by flat headed recessed screws so that the head of the screws do not project past the surface of the pad. Each pad is evenly spaced circumferentially around the circumference of the inner barrel 12. The circumferential length of the bearing pads are each less than $\frac{1}{8}$ of the circumference of the inner barrel 12. Nylon bearing pads 52 are attached to the inner surface 34 of the outer barrel 22 at the top end 24. They also are evenly spaced circumferentially around the inner surface 34. They also have a circumferential length which is less than $\frac{1}{8}$ of the circumference of the inner barrel 12. The thickness of the bearing pads 50 and 52 are each less than $\frac{1}{2}$ the difference between the diameter of the outer surface 38 of the inner barrel and the inner surface 34 of the outer barrel.

Therefore, it may be seen that the bearing pads reduce friction and wear between the inner barrel and the outer barrel but do not prohibit the outer barrel from being disengaged from the inner barrel by extending the outer barrel to a disengaged position.

Bell 60 is attached to the bottom end 32 of the outer barrel 22. The bell is outward flaring. It is desired that the bell be made of a flexible, impact resistant polymer. The preferred material is polyurethane. The bell is the surface of a frustum 62 of a cone. At the small end 70 of the frustum 62 there is cylinder 64 integral with the frustum to form the bell 60. Preferably the cylinder 64 telescopes within the bottom end 32 of the outer barrel 22 so that outer surface 66 of cylinder 64 forms a tight fit with the inner surface 34 of the outer barrel. It is necessary for the cylinder to be no more than about 2 inches in length (preferably $1\frac{1}{2}$ inch) so that the bell 60 is bolted to the outer barrel 22.

The bell 60 has two advantageous functions. First it acts as a bumper against sides of wagons or trailers "T" to prevent damage both to the sides of the wagons or trailers, and to the outer barrel 22 of the suction pipe. Second, it improves the flow of air into the suction pipe 10. The preferred height "h" as seen on the drawings of the frustum is about 8 inches. The preferred apex angle "2 α" of the frustum is about 30°. Stated otherwise the angle of the sides of the frustum 62 and the sides of the cylinder 64 would be the shown angle "α" in the drawings and this would be about 15°. Therefore the diameter of the bell would be about 5 inches greater than the diameter of the outer barrel 22 of the suction pipe 10.

The design criteria for the apex angle of the bell is that it is desired that the bell not extend for an excessive length below the suction pipe and also, that the apex angle be great enough to be effective. In addition to this, it is desired that the outer edge of large end 68 of the bell 10 be extended far enough away to offer protection to the suction pipe and to the sides of the wagons or trailers so that this is the portion makes impact or contact and not the suction pipe itself. Considering these criteria, it is considered that approximately 20° is about the minimum desired apex angle. Likewise the maximum apex angle is primarily based upon not making the bottom of the suction pipe too cumbersome and also to have sufficient air velocity at this point to remove the seed cotton, which is often packed, from the module or wagon or trailer. Therefore the maximum apex angle is considered to be 60°, however, it is preferred that it be maintained less than 45°. Good success has been obtained using an apex angle of about 30° which means angle "α" is about 15°. Good success has been used having a thickness of the bell and cylinder being between about ½ inch and 1 inch thick.

Since the large end 68 of the bell 60 will be contacting the sides "T" of the trailers, it is desired that a bumper 72 be molded into the bell. Good success results with the thickness of the bell at the cylinder 64 and frustum 62 to be about ½ inch of 90 durometer polyurethane. The bumper on the outside surface of the bell at the large end 68 would increase this thickness to about ⅞ of an inch.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. A suction pipe in a cotton gin
a. said suction pipe having
i. an inner barrel with a bottom end and a top end connected to
ii. a four way pivot, and
iii. an outer barrel with a bottom end and a top end telescoped over the inner barrel,
b. a suction fan connected to the inner barrel for sucking the seed cotton as received by the gin and pneumatically conveying it to the cotton gin for processing;
c. wherein the improvement comprises:
d. an outward flaring bell having a large end and small end with the small end attached to the bottom of the outer barrel,
dd. said bell being the frustum of a cone having an apex angle of less than 60°.

2. The invention as defined in claim 1 further comprising:
e. said bell made of a flexible impact resistant polymer.

3. The invention as defined in claim 1 further comprising:
e. said bell made of polyurethane.

4. The invention as defined in claim 1 further comprising:
e. said bell being the frustum of a cone having an apex angle of about 20° to about 45°.

5. The invention as defined in claim 1 further comprising:
e. said bell being made of polyurethane,
f. said bell being the frustum of a cone having an apex angle of about 20° to about 45°, and
g. said bell having an integral cylindrical section on the small end thereof telescoped in the outer barrel, and
h. bolted thereto.

6. The invention as defined in claim 5 further comprising:
j. an integral bumper ring of increased thickness molded into the bell at the large end thereof.

7. A suction pipe in a cotton gin
a. said suction pipe having
i. an inner barrel with a bottom end and a top end connected to
ii. a four way pivot, and
iii. an outer barrel with a bottom end and a top end telescoped over the inner barrel,
b. a suction fan connected to the inner barrel for sucking the seed cotton as received by the gin and pneumatically conveying it to the cotton gin for processing;
c. wherein the improvement comprises:
d. four bearing pads attached to an outside surface of the bottom end of the inner barrel, and
e. four bearing pads attached to an inside surface of the top end of the outside barrel,
f. said pads evenly spaced circumferentially,
g. each of said pads having a circumferential length of less than one eighth of the circumference of inner barrel, and
h. each of said pads having a thickness of less than half the difference between the diameter of the inner barrel and the outer barrel.

8. The invention as defined in claim 7 further comprising:
j. said bearing pads made of nylon.

9. The invention as defined in claim 8 further comprising:
j. an outward flaring bell made of polyurethane,
k. said bell being the frustum of a cone having an apex angle of about 20° to about 45°, and
l. said bell having an integral cylindrical section on the small end thereof telescoped in the outer barrel, and
m. bolted thereto.

10. A suction pipe in a cotton gin
a. said suction pipe having
i. an inner barrel with a bottom end and a top end connected to
ii. a four way pivot, and
iii. an outer barrel with a bottom end and a top end telescoped over the inner barrel,
b. a suction fan connected to the inner barrel for sucking the seed cotton as received by the gin and pneumatically conveying it to the cotton gin for processing,
c. mechanical means for swinging the inner barrel from side to side;
d. wherein the improvement comprises:
e. a chain looped down from the four way pivot, and
f. a hook on the top end of the outer barrel,
g. so arranged and constructed so that when the outer barrel is fully raised and the suction pipe is swung to one side by said mechanical means the hook will engage the chain thereby holding to outer barrel in the raised position.

11. The invention as defined in claim 10 further comprising:

h. an outward flaring bell made of polyurethane.

j. said bell being the frustum of a cone having an apex angle of about 20° to about 45°, and k. said bell having an integral cylindrical section on the small end thereof telescoped in the outer barrel, and l. bolted thereto.

12. The invention as defined in claim 11 further comprising:

m. four bearing pads attached to an outside surface of the bottom end of the inner barrel, and n. four bearing pads attached to an inside surface of the top end of the outside barrel, o. said pads evenly spaced circumferentially, p. each of said pads having a circumferential length of less than one eighth of the circumference of inner barrel, and q. each of said pads having a thickness of less than half the difference between the diameter of the inner barrel and the outer barrel.

13. A process of manipulating a suction pipe in a cotton gin a. said suction pipe having i. an inner barrel with a bottom end and a top end connected to ii. a four way pivot, and iii. an outer barrel with a bottom end and a top end telescoped over the inner barrel, b. a suction fan connected to the inner barrel for sucking the seed cotton as received by the gin and pneumatically conveying it to the cotton gin for processing, c. mechanical means for swinging the suction pipe from side to side;

d. wherein the improved method comprises:

e. raising the outer barrel to the fully raised position, then f. swinging the suction pipe toward a chain hanging from the four way pivot, thus g. bringing a hook on the top of the outer barrel over the chain, then h. lowering the outer barrel thus j. engaging the hook with the chain, thereby k. hanging the outer barrel by the chain.

14. The process as defined in claim 13 further comprising:

l. raising the outer barrel thereby m. disengaging the hook from the chain, then n. moving the suction pipe to a central position, thereby o. freeing the pipe from the chain.

* * * * *